US006893017B1

(12) United States Patent
Thomas et al.

(10) Patent No.: US 6,893,017 B1
(45) Date of Patent: May 17, 2005

(54) COMBINED SHUFFLE BOARD AND POOL GAME ASSEMBLY

(76) Inventors: Jerry L. Thomas, 1121 Hawthorne La., Charlotte, NC (US) 28205; R. Vernon Allen, 1121 Hawthorne La., Charlotte, NC (US) 28205

( * ) Notice: Subject to any disclaimer, the term of this patent is extended or adjusted under 35 U.S.C. 154(b) by 0 days.

(21) Appl. No.: 10/734,885

(22) Filed: Dec. 15, 2003

(51) Int. Cl.[7] ..... A63F 7/00; A63D 15/00
(52) U.S. Cl. ..... 273/126 R; 473/1
(58) Field of Search ..... 273/126 R, 126 A, 273/123 R; 473/1, 28, 40; 472/92

(56) References Cited

U.S. PATENT DOCUMENTS

| | | | | |
|---|---|---|---|---|
| 2,470,238 A | | 5/1949 | Correale | |
| 2,628,103 A | | 2/1953 | Parmer | |
| 2,832,598 A | * | 4/1958 | Strub | 273/129 R |
| 3,591,176 A | | 7/1971 | Roth | |
| 3,802,707 A | * | 4/1974 | Frost | 273/123 R |
| 3,811,673 A | * | 5/1974 | Baker | 473/31 |
| 3,947,035 A | * | 3/1976 | Bouchard | 273/126 R |
| 4,229,004 A | | 10/1980 | Stokes | |
| 4,549,735 A | * | 10/1985 | Dunn et al. | 473/32 |
| 4,579,342 A | * | 4/1986 | Mortensen | 473/3 |
| 4,957,288 A | | 9/1990 | Kantner | |
| 5,011,147 A | | 4/1991 | Thomas | |
| D343,869 S | | 2/1994 | Atkinson | |
| 5,472,211 A | * | 12/1995 | McCaughan | 273/401 |
| 5,591,087 A | | 1/1997 | Salinas | |
| 5,820,470 A | * | 10/1998 | Saunders | 472/92 |

FOREIGN PATENT DOCUMENTS

GB 2235632 * 3/1991

* cited by examiner

*Primary Examiner*—Raleigh W. Chiu

(57) ABSTRACT

A combined shuffleboard and pool game assembly includes a playing surface that has a substantially rectangular shape and a plurality of elongated rails removably engageable with the playing surface. The plurality of rails include opposed arcuate end portions for defining a plurality of pockets when engaged with each other. A plurality of elongated bumpers are spaced from each other and are attached to the plurality of rails that extend along the length and width of the playing surface. The plurality of elongated bumpers have opposed end portions disposed adjacent the plurality of arcuate end portions respectively. An accessory kit is provided for allowing players to participate in any one of a number of various games of their choice.

10 Claims, 8 Drawing Sheets

COMBINED SHUFFLE BOARD AND POOL GAME ASSEMBLY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a combined shuffleboard and billiards game and, more particularly, to a portable shuffleboard and billiards game assembly.

2. Prior Art

The increasing popularity of skill games is evident by the introduction of new games being devised and placed on the market. Consumer appeal is enhanced by the fact that more people, now more than ever before, have leisure time available, and these people are seeking new ways of passing this time as pleasantly as possible. In the past, games have been constructed to include a playing surface upon which playing balls are placed to be projected by a club or cue stick into target pockets placed on the playing surface. However, these prior constructions have failed to include a means for easily disassembling the game when not in use to thereby facilitate the storage thereof.

Further, past devices have generally neglected to include flexibility in construction to permit use of the game in a manner that would permit a natural ground surface to function as an indoor or outdoor playing surface.

Further, prior art attempts have been made to provide games that employ single length shuffleboards. Such games are often permanently secured to a ground surface, which prohibits the players of the game to transport same when not in use. In an effort to overcome such a shortcoming, some prior art assemblies include short dividers that can be removably attached to each other. However, such prior art attempts do not combine to provide a simple construction and still provide the excitement of a full-scale game.

Accordingly, there remains a need to provide a portable shuffleboard and billiards game assembly that can be readily disassembled by a user.

BRIEF SUMMARY OF THE INVENTION

In view of the foregoing background, it is therefore an object of the present invention to provide a combined shuffleboard and pool game assembly. These and other objects, features, and advantages of the invention are provided by a combined shuffleboard and pool game assembly including a playing surface that has a substantially rectangular shape and a plurality of elongated rails removably engageable with the playing surface.

The playing surface preferably includes a plurality of panels removably engageable with each other and disposable between the plurality of rails so that the assembly can be disengaged and transported between select locations. A plurality of elongated support members are positionable below the plurality of panels for maintaining same at stable positions. The plurality of panels further include at least one tongue and at least one groove selectively engageable therewith and for maintaining the plurality of panels at a substantially stable position during operating conditions. Select ones of the plurality of panels further include oppositely spaced side portions including a plurality of grooves formed therealong for assisting a player to transport same.

In an alternate embodiment, the playing surface is preferably formed from concrete and includes a plurality of sloped portions disposed within the plurality of pockets for allowing water to drain therefrom.

The plurality of rails include opposed arcuate end portions for defining a plurality of pockets when engaged with each other. The plurality of elongated bumpers are spaced from each other and attached to the plurality of rails. Such a plurality of rails extend along the length and width of the plurality of panels. A plurality of bumpers, which include opposed end portions, are disposed adjacent to the plurality of arcuate portions of the rails, respectively.

The present invention further includes a plurality of annular discs having indicia thereon, and are assignable to a player during a game. The assembly further includes at least one elongated member selectively operable by a player and engageable with the plurality of discs for moving same across the playing surface and into the plurality of pockets. Such an elongated member includes a substantially arcuate lower end portion including a pair of oppositely spaced guide members connected thereto and for receiving and directing the plurality of discs across the playing surface as desired by a user.

The present invention further includes a rack having a substantially triangular shape for grouping together the plurality of discs at a predetermined position of the playing surface.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
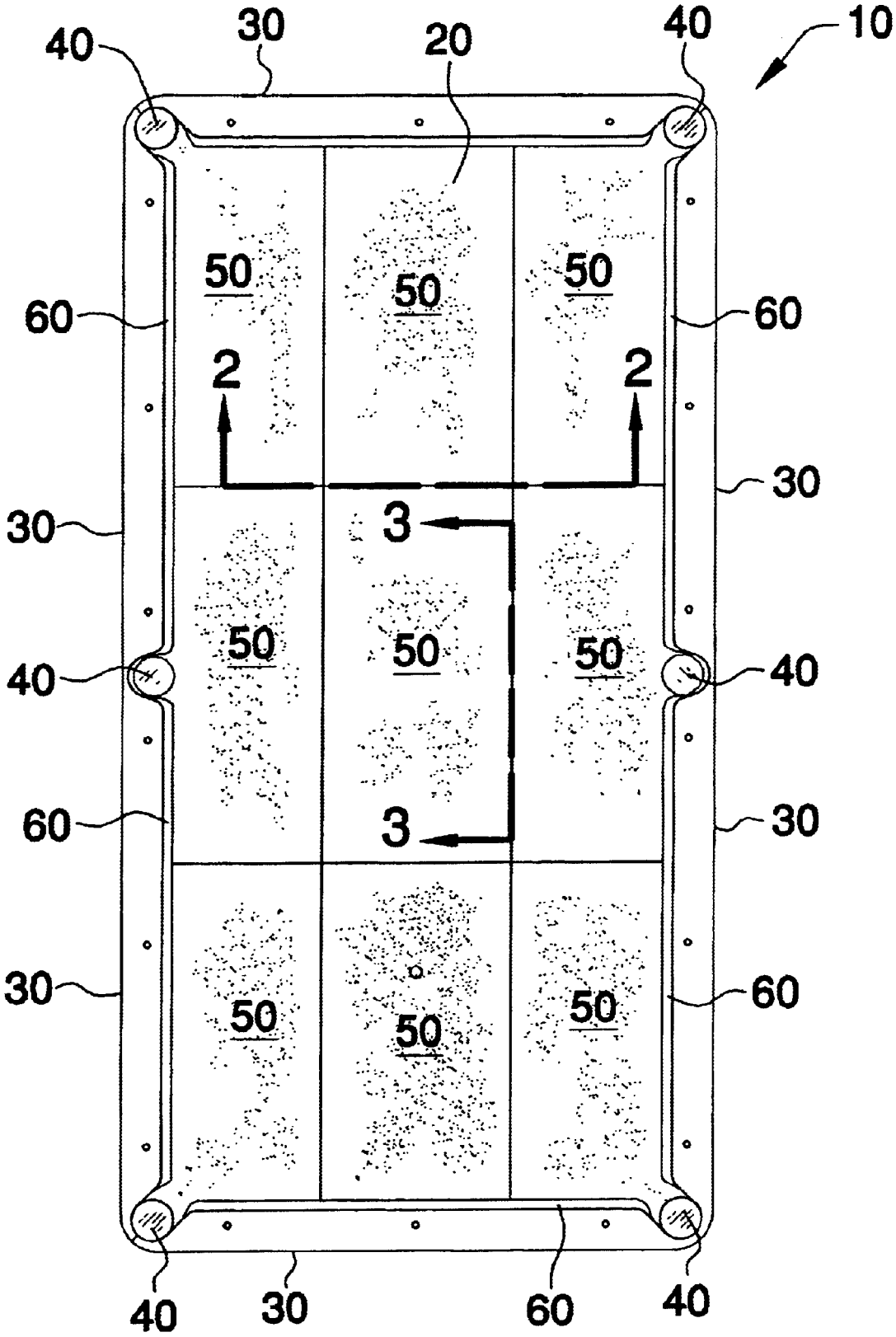
FIG. 1 is a top plan view showing a combined shuffleboard and pool game assembly, in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements and prime notations refer to alternate embodiments of similar elements throughout the figures.

The apparatus of this invention is referred to generally in FIGS. 1–9 by the reference numeral 10 and is intended to provide a combined shuffleboard and pool game. It should be understood that the apparatus 10 may be used to provide many different types of games and therefore should not be construed as limited to only a combined shuffleboard and pool assembly.

Figure 5:
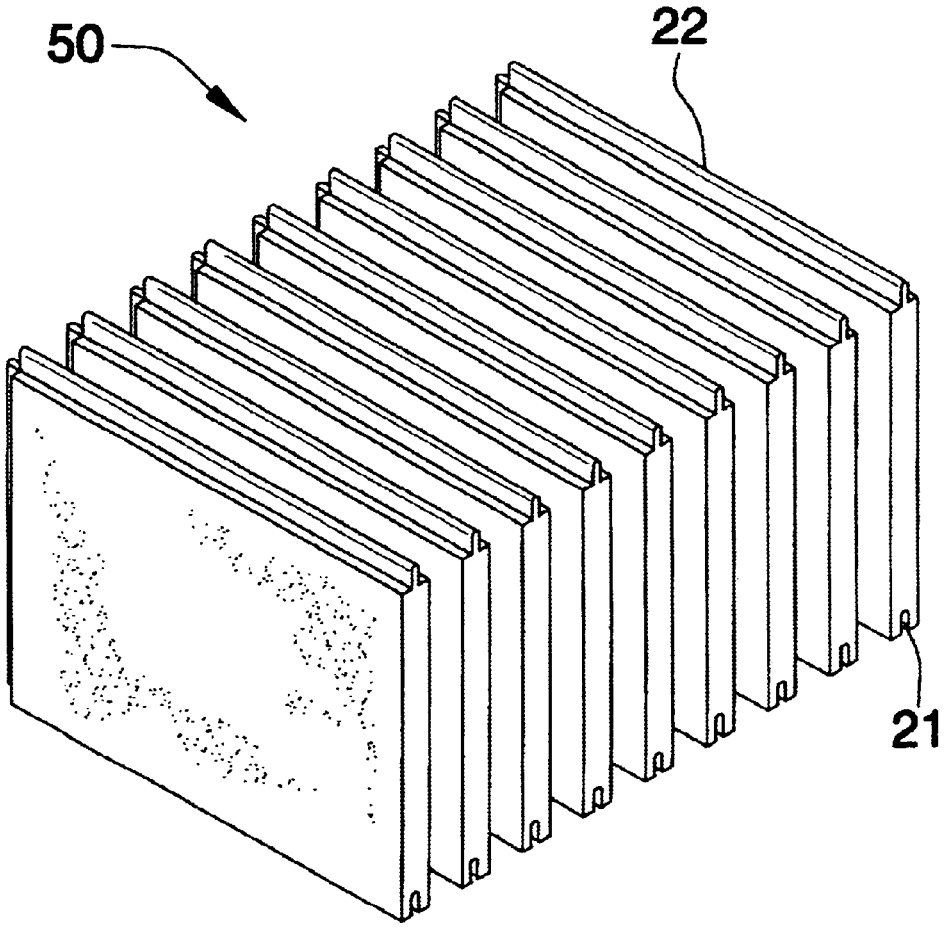
FIG. 5 is a perspective view showing a plurality of panels disengaged from each other and stacked side-by-side.
Figure 7:
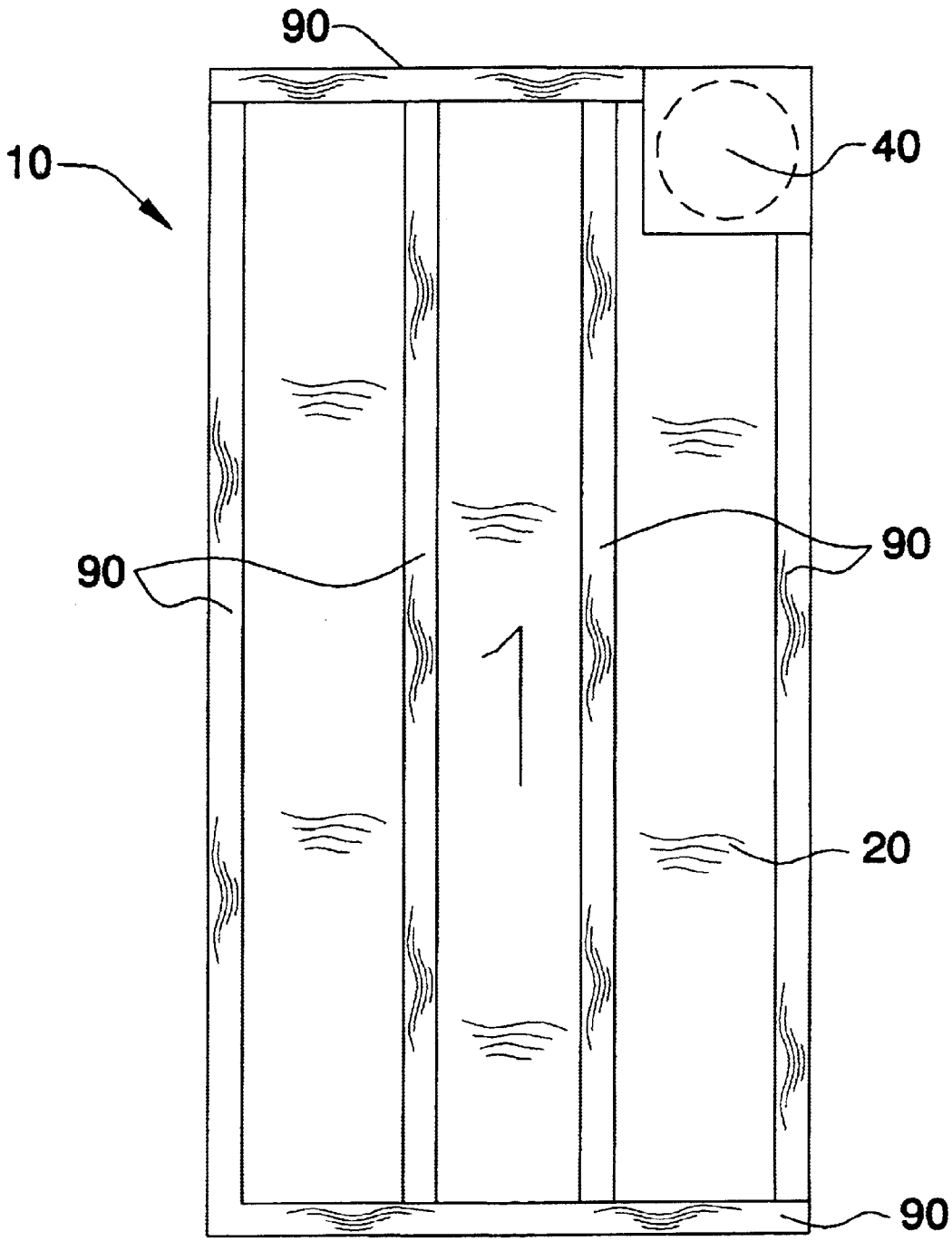
FIG. 7 is a bottom plan view showing panel number 1 of 9, in FIG. 1.

Referring initially to FIG. 1, the assembly 10 includes a playing surface 20 preferably including a plurality of panels 50 removably engageable with each other and disposable between a plurality of rails 30 so that the assembly can be disengaged and transported between select locations, as perhaps best shown in FIG. 5. A plurality of elongated support members 90 are positionable below the plurality of panels 50 for maintaining same at stable positions, as best shown in FIG. 7.

Figure 2:
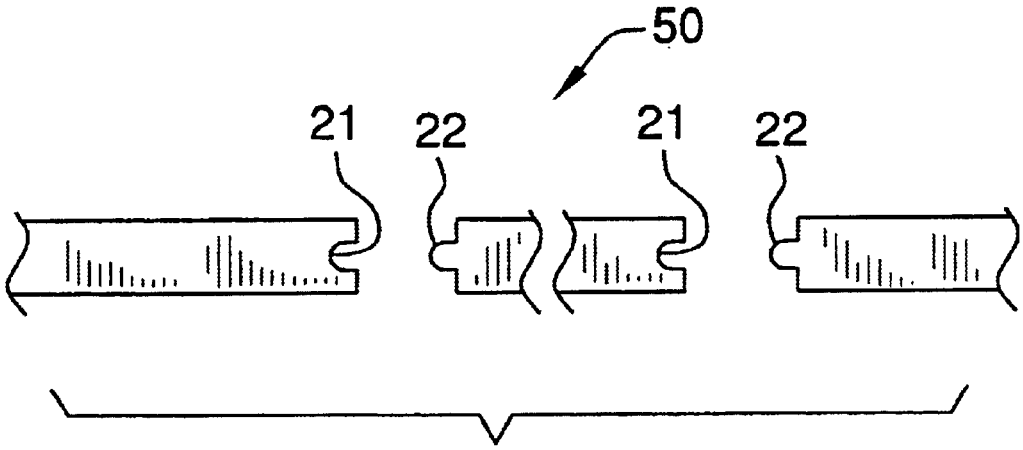
FIG. 2 is a partial cross-sectional view of FIG. 1, taken along line 2—2.
Figure 3:
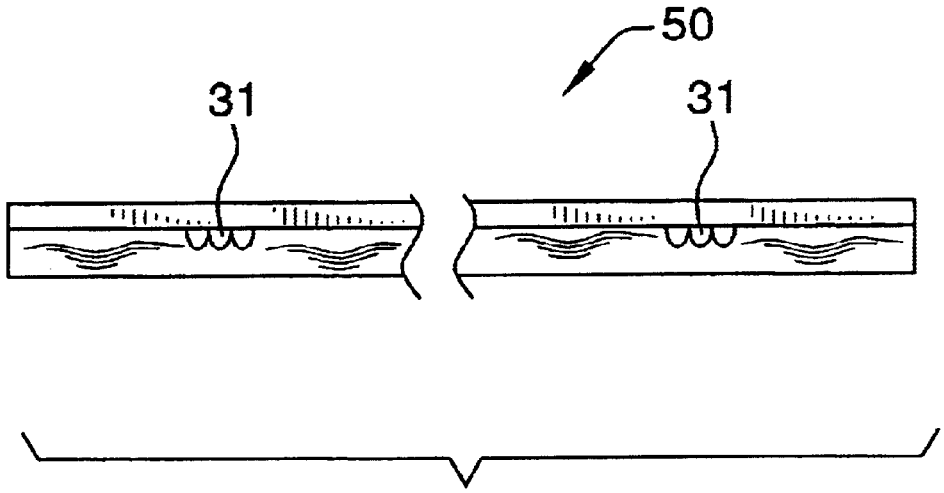
FIG. 3 is a partial cross-sectional view of FIG. 1, taken along line 3—3.

Now referring to FIGS. 2 and 3, the plurality of panels 50 further include at least one tongue 22 and at least one groove 21 selectively engageable therewith and for maintaining the plurality panels 50 at a substantially stable position during operating conditions. Select ones of the plurality of panels 50 further include oppositely spaced side portions including a plurality of grooves 31 formed therealong for assisting a player to transport same.

Figure 8:
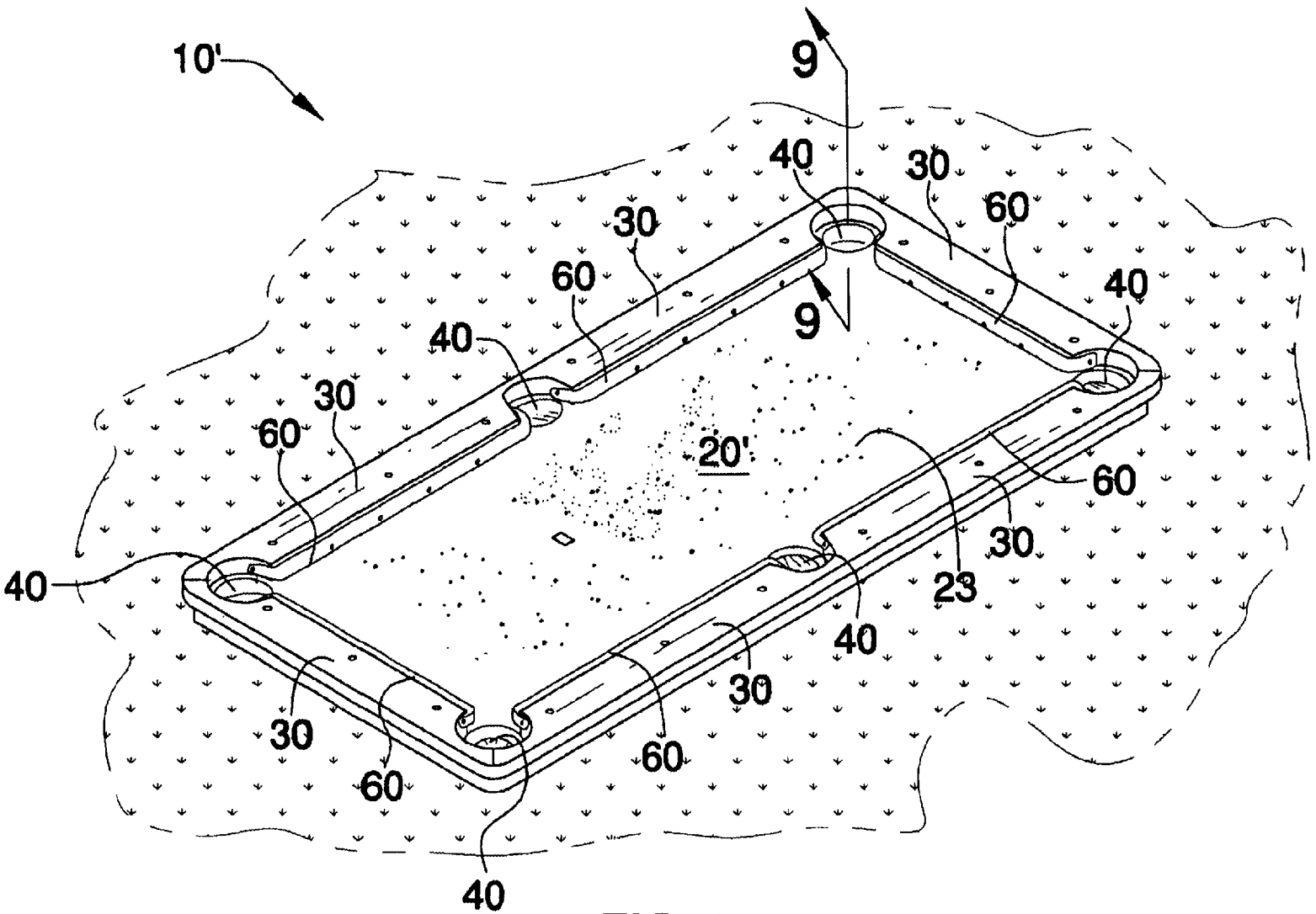
FIG. 8 is a perspective view showing an alternate embodiment of FIG. 1.
Figure 9:
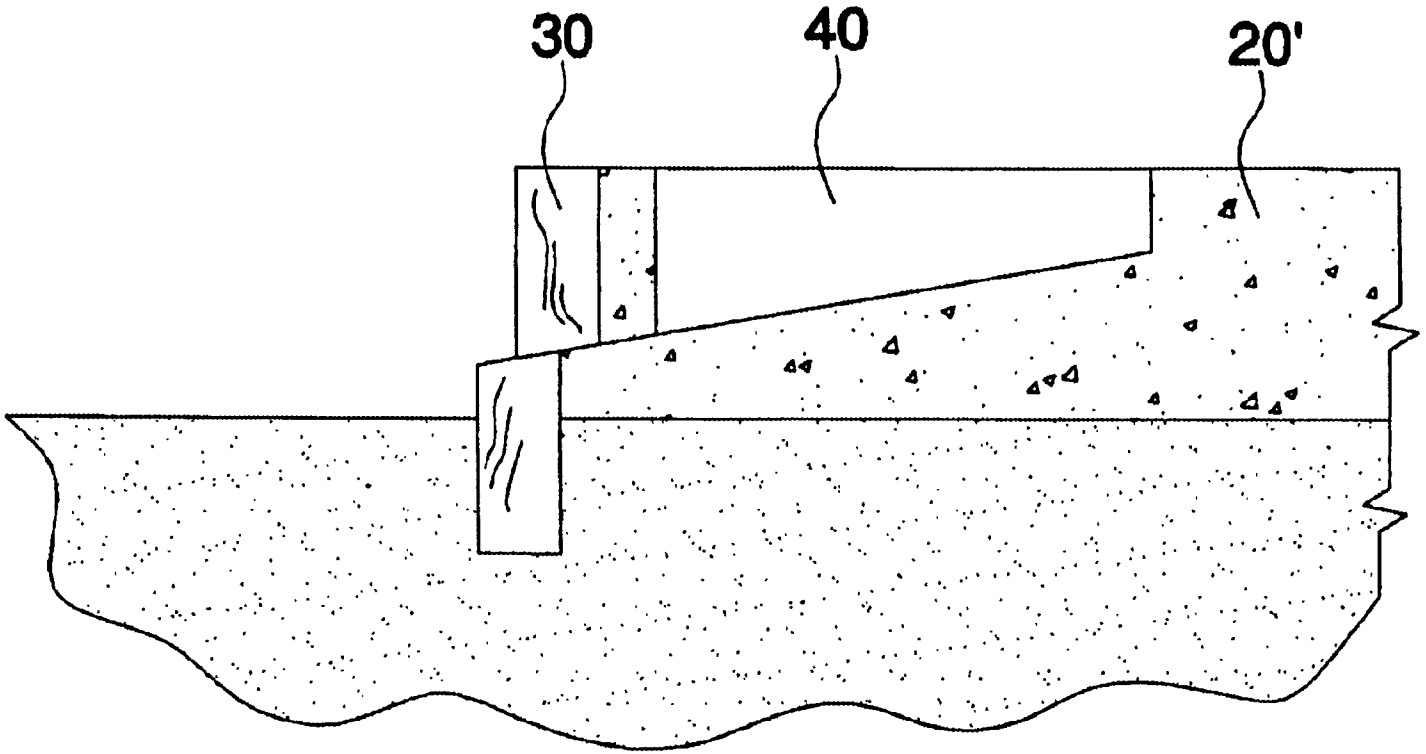
FIG. 9 is an enlarged cross-sectional view of a pocket taken along line 9—9 in FIG. 8.

In an alternate embodiment, the playing surface 20' is preferably formed from concrete 23 and includes a plurality of sloped portions disposed within the plurality of pockets 40 for allowing water to drain therefrom, as best shown in FIGS. 8 and 9.

Figure 6:
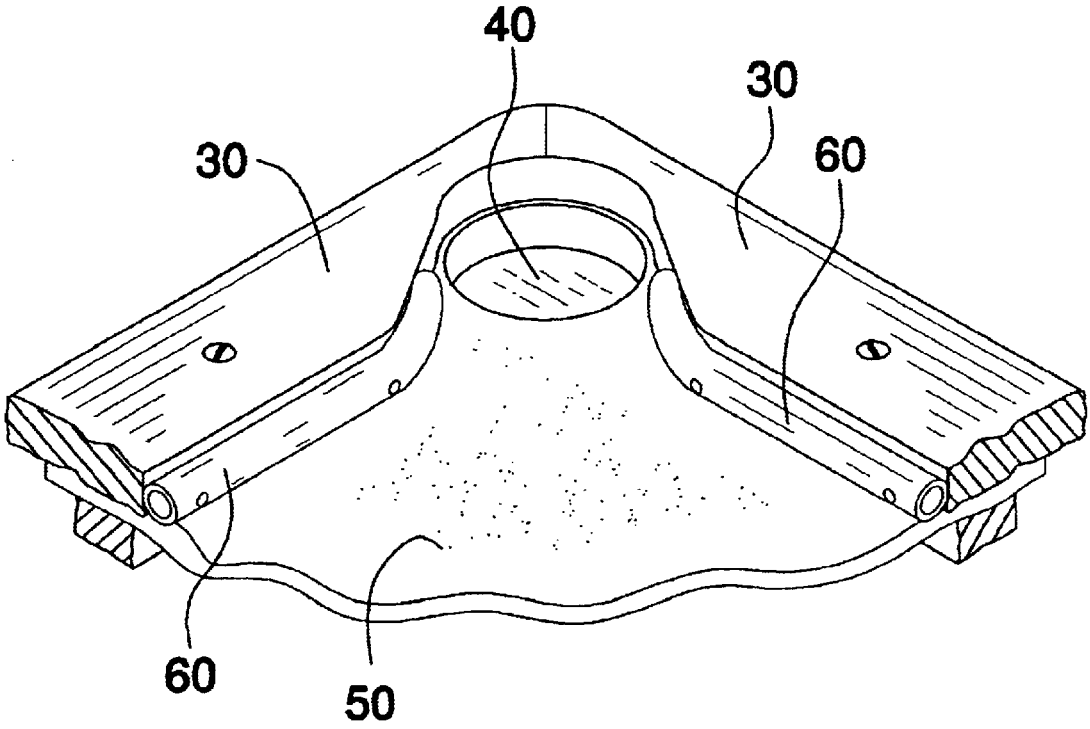
FIG. 6 is a partial perspective view showing the arrangement of a pair of rails and a corner pocket.

Now referring to FIG. 6, the plurality of rails 30 include opposed arcuate end portions for defining a plurality of pockets 40 when engaged with each other. A plurality of elongated bumpers 60 are spaced from each other and attached to the plurality of rails 30. Such a plurality of rails 30 extend along the length and width of the plurality of panels 50. A plurality of bumpers 60, which include opposed end portions, are disposed adjacent the plurality of arcuate portions respectively.

Figure 4:
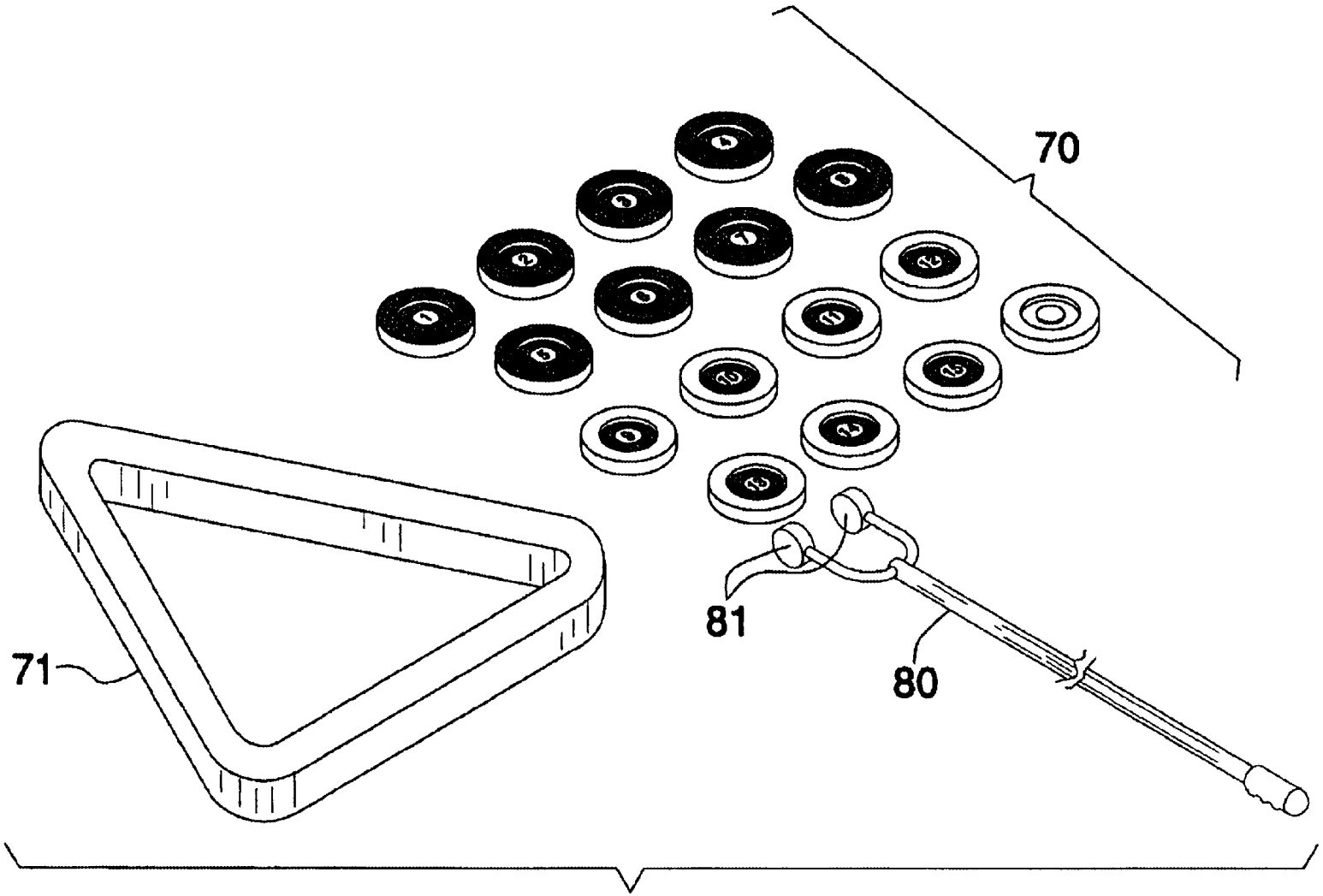
FIG. 4 is a perspective view showing the accessories of the present invention.

Now referring to FIG. 4, the present invention further includes a plurality of annular discs 70 having indicia thereon, and are assignable to a player during a game. The assembly further includes at least one elongated member 80 selectively operable by a player and engageable with the plurality of discs 70 for moving same across the playing surface 20 and into the plurality of pockets 40. Such an elongated member 80 includes a substantially arcuate lower end portion including a pair of oppositely spaced guide members 81 connected thereto and for receiving and directing the plurality of discs 70 across the playing surface 20 as desired by a user.

The present invention further includes a rack 71 having a substantially triangular shape for grouping together the plurality of discs 70 at a predetermined position of the playing surface 20.

The combined shuffleboard and pool assembly 10 provides a fun, entertaining, and competitive game system for individuals of all ages. Combing the aspects of billiards with those of shuffleboard, this new game allows players to compete in an oversized or giant game of pool. Two players or teams of players could participate and attempt to "sink" their discs in the pockets of the playing surface 20. The plastic discs 70 move smoothly over the playing surface 20, while the bumpers 60 and side rails 30 provide realistic billiard style action.

The combined shuffle board and pool assembly is ideal for senior living centers and nursing homes, schools, churches, country clubs, community activity centers, and other such facilities that can accommodate organized gatherings. Playing the game would encourage social interaction, which in turn would enable players to meet new people, make new friends, and possibly even "acquaintances" of the opposite sex.

From their physical activity in playing the game, participants would derive the benefits of wholesome exercise and exposure to the out-of-doors. Fresh air and sunshine coupled with the physical activity promote good health and well-being.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined shuffle board and pool game assembly comprising:

a playing surface having a substantially rectangular shape;

a plurality of elongated rails removably engages ble with said playing surface, said plurality of rails including opposed arcuate end portions for defining a plurality of pockets when engaged with each other;

a plurality of elongated bumpers spaced from each other and attached to said plurality of rails and extending along a length and a width of said playing surface, said plurality of elongated bumpers having opposed end portions disposed adjacent said plurality of arcuate end portions respectively;

a plurality of annular discs having indicia thereon and being assignable to a player during a game; and at least one elongated member selectively operable by a player and engageable with said plurality of discs for moving same across said playing surface and into said plurality of pockets;

said playing surface comprising a plurality of panels removably engageable with each other and disposable between said plurality of rails so that said assembly can be disengaged and transported between select locations, and a plurality of elongated support members positionable below said plurality of panels for maintaining same at stable positions.

2. The assembly of claim 1, further comprising:

a rack having a substantially triangular shape for grouping together said plurality of discs at a predetermined position of said playing surface.

3. The assembly of claim 1, wherein said at least one elongated member comprises:

a substantially arcuate lower end portion including a pair of oppositely spaced guide members connected to said at least one elongated member and for receiving and directing said plurality of discs across said playing surface as desired by a user.

4. The assembly of claim 1, wherein said plurality of panels further comprise:

at least one tongue and at least one groove selectively engageable therewith and for maintaining said plurality of panels at a substantially stable position during operating conditions.

5. The assembly of claim 1, wherein select ones of said plurality of panels further comprise:

oppositely spaced side portions including a plurality of grooves formed there along for assisting a player to transport same.

6. The assembly of claim 1, wherein said playing surface is formed from concrete, said playing surface including a plurality of sloped portions disposed within said plurality of pockets for allowing water to drain there from.

7. A combined shuffle board and pool game assembly comprising:

a playing surface having a substantially rectangular shape:

a plurality of elongated rails removably engageable with said playing surface, said plurality of rails including opposed arcuate end portions for defining a plurality of pockets when engaged with each other;

a plurality of elongated bumpers spaced from each other and attached to said plurality of rails and extending along a length and a width of said playing surface, said plurality of elongated bumpers having opposed end portions disposed adjacent said plurality of arcuate end portions respectively;

a plurality of annular discs having indicia thereon and being assignable to a player during a game;

at least one elongated member selectively operable by a player and engageable with said plurality of discs for moving same across said playing surface and into said plurality of pockets; and a rack having a substantially triangular shape for grouping together said plurality of discs at a predetermined position of said playing surface;

said playing surface comprising a plurality of elongated panels removably engageable with each other and disposable between said plurality of rails so that said assembly can be disengaged and transported between select locations, said panel having generally rectangular shapes; and a plurality of elongated support members positionable below said plurality of panels for maintaining same at stable positions; wherein said plurality of panels further comprise at least one tongue and at least one groove selectively engageable therewith and for maintaining said plurality of panels at a substantially stable position during operating conditions.

8. The assembly of claim 7, wherein said at least one elongated member comprises:

a substantially arcuate lower end portion including a pair of oppositely spaced guide members connected to said at least one elongated member and for receiving and directing said plurality of discs across said playing surface as desired by a user.

9. The assembly of claim 7, wherein select ones of said plurality of panels further comprise:

oppositely spaced side portions including a plurality of grooves formed there along for assisting a player to transport same.

10. The assembly of claim 7, wherein said playing surface is formed from concrete, said playing surface including a plurality of sloped portions disposed within said plurality of pockets for allowing water to drain there from.

* * * * *